United States Patent [19]

Wentzell

[11] 4,431,443

[45] Feb. 14, 1984

[54] METHODS OF VACUUM ARC MELTING

[76] Inventor: Joseph M. Wentzell, Ty Careg, Remsen, N.Y. 13438

[21] Appl. No.: 450,515

[22] Filed: Dec. 17, 1982

[51] Int. Cl.[3] ..... C22B 4/00; C21C 7/10

[52] U.S. Cl. ..... 75/102; 75/10 R; 75/49; 75/59

[58] Field of Search ..... 75/49, 59, 102, 10 R

[56] References Cited

U.S. PATENT DOCUMENTS 3,854,932 12/1974 Bishop ..... 75/49
4,154,603 5/1979 Oguchi ..... 75/49
4,160,664 7/1979 Maruhashi ..... 75/49
4,200,452 4/1980 Savov ..... 75/49

*Primary Examiner*—Peter D. Rosenberg
*Attorney, Agent, or Firm*—Buell, Blenko, Ziesenheim & Beck

[57] ABSTRACT

A method is provided for substantially eliminating metal condensates on the walls of a vacuum arc melting vessel above a molten metal pool by the step of providing an atmosphere of non-condensible gas in the vessel above the molten metal pool during the melting operation.

10 Claims, No Drawings

METHODS OF VACUUM ARC MELTING

This invention relates to methods of vacuum arc melting and particularly to a method of arc melting to avoid the formation of metal condensate on the crucible wall above the molten metal.

In the vacuum arc melting of superalloys such as Inco 718 there is a problem which manifests itself in the form of "white spots" in the cast ingot and in the subsequent billet or product made therefrom when the metal is etched. The material which causes these "white spots" has been identified as "shelf" or metal condensate which forms on the cold copper crucible above the melt. This condensate periodically breaks free from the cold wall and falls into the molten metal. The molten pool must be maintained in a relatively quiescent condition to prevent the formation of an agglomerate Laves phase, $Ni_2Cb$, which forms during the freezing of the molten metal. The $Ni_2Cb$ is considerably heavier than the matrix metal and is prone to agglomerate at the bottom of the metal pool. It can be thought of as a very sticky fluid which can roll around on the pool base much like water on the base of a can of gasoline. If the $Ni_2Cb$ does agglomerate the resulting segregation manifests itself as large black spots when etched. It is thus important to maintain a quiescent pool which precludes magnetically stirring or otherwise agitating the pool to mix the fallen "shelf" or condensate into the pool.

I have found that the condensate has a high concentration of the more volatile elements of the alloy composition as well as the more abundant elements.

I have discovered that if the volume of the container above the molten metal pool is filled with a non-condensible gas instead of the volatilized metal gas, the build-up of this objectionable "shelf" is greatly reduced if not entirely eliminated. If the non-condensible gas is a large molecule which does not act as a perfect gas, it tends to force the volatile metal molecules back to the molten metal pool surface. Also, I have found that high energy gas ions or molecules which strike the metal crucible wall tend to clean the wall of condensate.

The present invention provides a method of controlling the deposition of metal condensate on a container wall in vacuum arc melting by the steps of providing an atmosphere of non-condensible gas in the container. Preferably the non-condensible gas is made up of a combination of gases, one of which enhances the thermoconductivity of the melting atmosphere to reduce the heat in the bath and increase the heat flow to the electrode. A preferred combination of gases includes a major portion of argon and a minor portion of helium. Preferably the combination of gases is about four parts argon and one part helium by volume.

In the foregoing general description, I have set out certain objects, purposes and advantages of my invention. Other objects, purposes and advantages of this invention will be apparent from a consideration of the following description of the practice of this invention.

As an example of the practice of this invention, a five ton electrode of Inco 718 would be placed in a copper crucible of a vacuum consumable electrode arc furnace. The crucible would be evacuated and an atmosphere of 20% helium and 80% argon at 10 mm Hg pressure introduced in the crucible. The consumable electrode then would be melted in the usual manner to form a final ingot in the crucible. The ingot would be cooled and removed from the crucible and would be substantially free from "white spots".

In the foregoing specification I have set out certain preferred practices and embodiments of my invention, however, it will be understood that this invention may be otherwise embodied within the scope of the following claims.

I claim:

1. The method of eliminating metal condensate on the walls of a closed melting vessel above a non-ferrous superalloy molten metal pool during metal melting comprising the steps of evacuating the vessel and thereafter providing an atmosphere of a non-condensible gas in the vessel above the molten pool during the melting operation sufficient to suppress the formation and condensation above the molten pool of metal gases from the pool.

2. The method as claimed in claim 1 wherein the non-condensible gas has a pressure greater than the partial pressure of metal gases at the molten pool surface.

3. The method as claimed in claim 1 wherein the non-condensible gas is a mixture of gases, at least one of which enhances the thermoconductivity of the melting atmosphere to reduce the heat in the bath and increase the heat flow to the electrode.

4. The method as claimed in claim 1 wherein the non-condensible gas is a mixture of argon and helium.

5. The method as claimed in claim 4 wherein the mixture is about 20% helium and 80% argon.

6. The method as claimed in claim 4 wherein the mixture is a major portion of argon and a minor portion of helium.

7. The method as claimed in claim 2 wherein the non-condensible gas is a mixture of gases, at least one of which enhances the thermoconductivity of the melting atmosphere to reduce the heat in the bath and increase the heat flow to the electrode.

8. The method as claimed in claim 2 wherein the non-condensible gas is a mixture of argon and helium.

9. The method as claimed in claim 8 wherein the mixture is about 20% helium and 80% argon.

10. The method as claimed in claim 8 wherein the mixture is a major portion of argon and a minor portion of helium.

* * * * *

UNITED STATES PATENT AND TRADEMARK OFFICE

CERTIFICATE OF CORRECTION

PATENT NO. : 4,431,443

DATED : February 14, 1984

INVENTOR(S) : Joseph M. Wentzell

It is certified that error appears in the above-identified patent and that said Letters Patent is hereby corrected as shown below:

Claim 1, column 2, line 24, --metal-- should be inserted after "molten".

Signed and Sealed this

*Nineteenth* Day of *June 1984*

[SEAL]

*Attest:*

GERALD J. MOSSINGHOFF

*Attesting Officer*

*Commissioner of Patents and Trademarks*